US008714395B2

(12) United States Patent
Monzel

(10) Patent No.: US 8,714,395 B2
(45) Date of Patent: May 6, 2014

(54) CONTAINER, IN PARTICULAR A LARGE-VOLUME DISPOSABLE CONTAINER MADE OF PLASTIC, SUCH AS A KEG FOR RECEIVING BEVERAGES

(75) Inventor: Alois Monzel, Mörstadt (DE)

(73) Assignee: KHS GmbH, Dortmund (DE)

( * ) Notice: Subject to any disclaimer, the term of this patent is extended or adjusted under 35 U.S.C. 154(b) by 131 days.

(21) Appl. No.: 13/058,594

(22) PCT Filed: Oct. 23, 2009

(86) PCT No.: PCT/EP2009/007575

§ 371 (c)(1),
(2), (4) Date: Feb. 11, 2011

(87) PCT Pub. No.: WO2010/049095

PCT Pub. Date: May 6, 2010

(65) Prior Publication Data

US 2011/0139786 A1 Jun. 16, 2011

(30) Foreign Application Priority Data

Oct. 29, 2008 (DE) ..... 10 2008 053 716

(51) Int. Cl.
*B65D 51/16* (2006.01)

(52) U.S. Cl.
USPC ..... 220/367.1; 222/147

(58) Field of Classification Search
USPC ..... 220/367.1, 203.08, 203.14, 220/203.23–203.25, 203.01, 203.1, 203.11, 220/203.29, 240, 360, 361; 215/307, 315; 222/397
See application file for complete search history.

(56) References Cited

U.S. PATENT DOCUMENTS

| | | | | |
|---|---|---|---|---|
| 2,071,877 | A | 2/1937 | Harris | |
| 2,757,964 | A * | 8/1956 | Both et al. | 222/397 |
| 4,142,658 | A * | 3/1979 | Golding | 222/400.7 |
| 4,834,266 | A * | 5/1989 | Brewer et al. | 222/147 |
| 5,595,208 | A * | 1/1997 | Augustinus et al. | 137/68.11 |
| 5,848,740 | A * | 12/1998 | Burghaus | 222/397 |
| 6,089,415 | A * | 7/2000 | Terpstra et al. | 222/397 |
| 7,546,935 | B2 * | 6/2009 | Wheaton | 222/400.7 |
| 2009/0206505 | A1 | 8/2009 | Monzel et al. | |
| 2009/0320264 | A1 * | 12/2009 | Berger et al. | 29/428 |
| 2010/0308544 | A1 * | 12/2010 | Riis | 277/602 |

FOREIGN PATENT DOCUMENTS

| | | | |
|---|---|---|---|
| DE | 10138365 | 2/2003 | |
| DE | 102005054305 | 6/2006 | |
| DE | 102006034638 | 1/2008 | |
| WO | WO 99/14156 A1 * | 3/1999 | B67D 1/08 |

* cited by examiner

*Primary Examiner* — J. Gregory Pickett
*Assistant Examiner* — Mollie Llewellyn
(74) *Attorney, Agent, or Firm* — Occhiuti & Rohlicek LLP

(57) ABSTRACT

The subject matter of the present invention is a container, in particular a large-volume disposable container made of plastic, such as a keg (1) for holding liquids of all types, for example, for holding beverages. The container is equipped in general with a connecting fitting (2) having a gasket (3). According to the invention, the connecting fitting (2) and/or the gasket (3) define an unclosable passage (9) for reducing pressure inside the container during the subsequent automatic closing operation after a previously defined opening operation.

13 Claims, 2 Drawing Sheets

Figure 1:
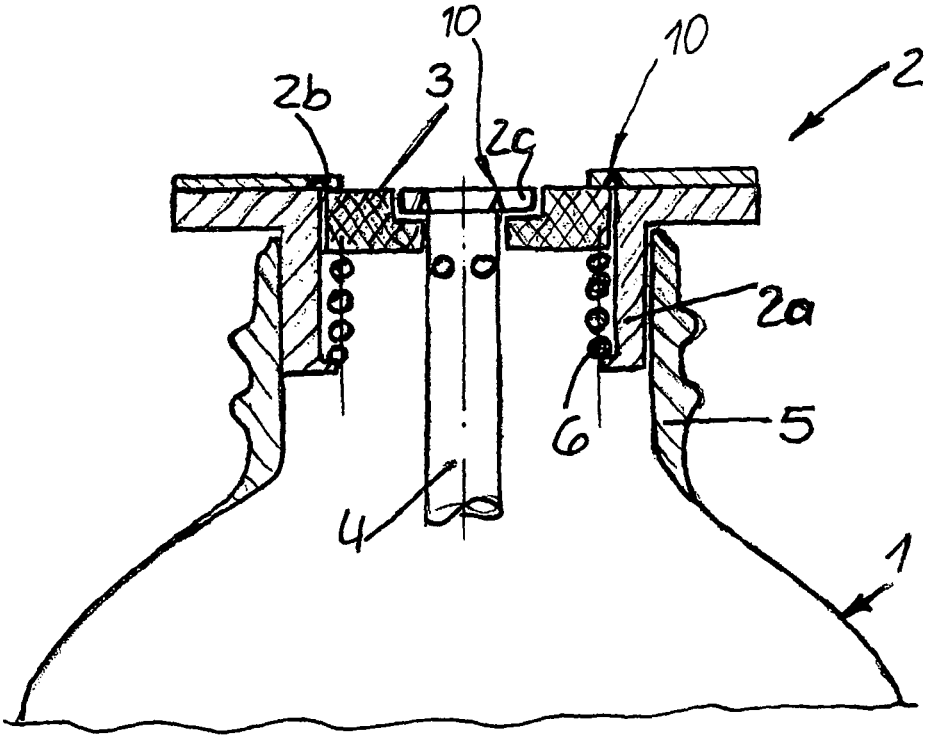

Fig. 2
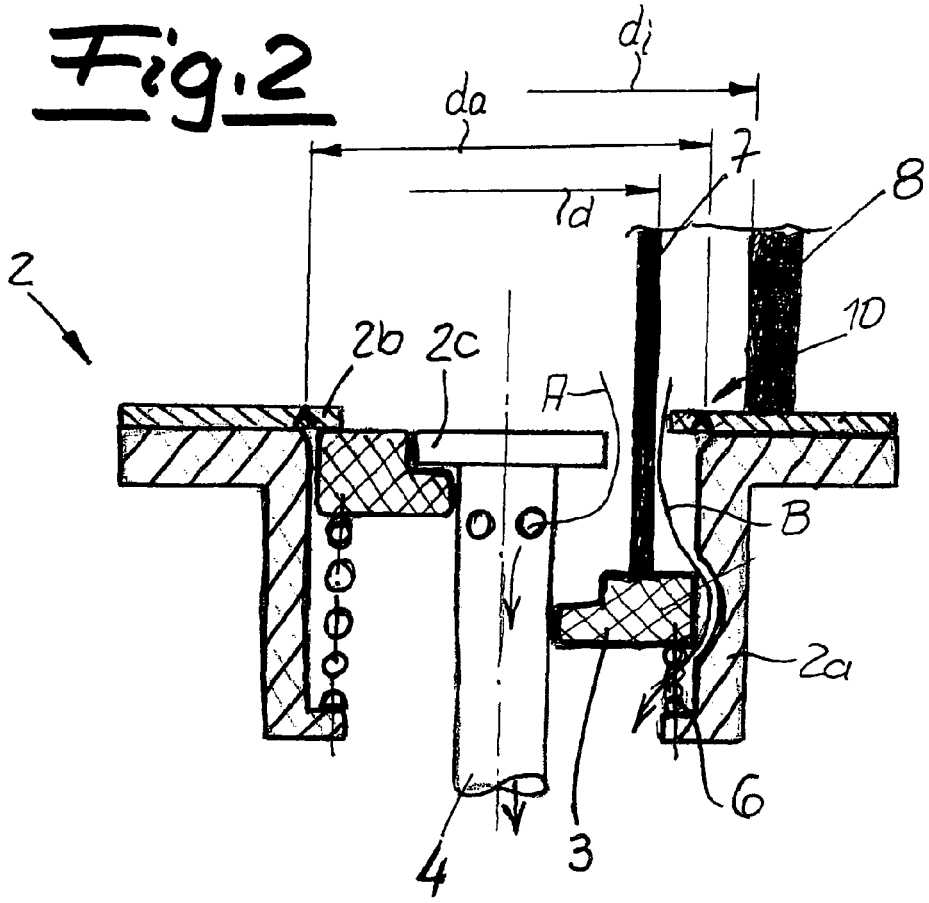
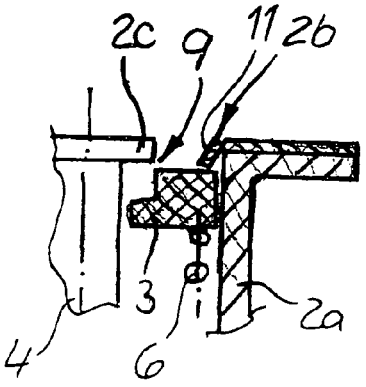
Fig. 3A
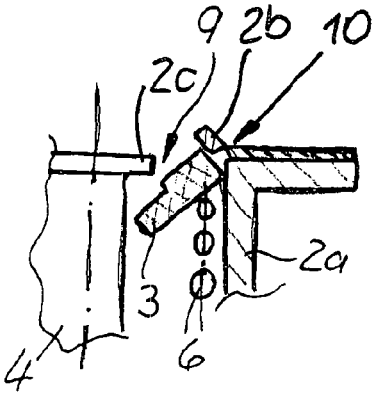
Fig. 3B

CONTAINER, IN PARTICULAR A LARGE-VOLUME DISPOSABLE CONTAINER MADE OF PLASTIC, SUCH AS A KEG FOR RECEIVING BEVERAGES

CROSS-REFERENCE TO RELATED APPLICATIONS

This application is the National Stage of International Application No. PCT/EP2009/007575, filed on Oct. 23, 2009, which claims the priority of German Patent Application No. 10 2008 053 716.0, filed on Oct. 29, 2008. The contents of both applications are hereby incorporated by reference in their entirety.

The invention relates to a container, in particular a large-volume disposable container made of plastics material such as, for example, a keg for accommodating liquids, for example for accommodating beverages, said container including a connecting fitting with a seal.

Such containers are known in practice and are described, for example, in WO 2008/083782 A2. Comparable developments are the objects of DE 101 38 365 A1 or DE 10 2006 034 638 A1.

Large-volume containers with a content typically in excess of 10 liters, in particular 30 liters or 50 liters, are generally used to store beverages such as, for example, beer and to dispense said beverages under pressure. Special large-volume containers, so-called keg casks, which are returnable vessels that have been developed for the industrial filling and germ-free storage of beverages, are thus known. The term "keg" or also "kegs" is derived from the English language and stands for "small cask". Keg casks are used extensively in gastronomy and are being used more and more in the private sphere in conjunction with associated tap dispensers.

As a rule, kegs or keg casks have a valve, the so-called keg head, at their top end. A suitable tap head can be mounted at said valve or the keg head, said tap head supplying a fuel gas, for example carbon dioxide or also nitrogen, from an external container and thus generating an overpressure in the interior of the container in question. This overpressure is responsible for the fact that the liquid stored in the vessel or container can be discharged via a rising pipe and a tap system. The tap head seals off the container in a leak proof manner such that the liquid stored therein remains germ-free.

Through the overpressure in the keg generated by the fuel gas, the beverage content is pushed out through the rising pipe in the interior of the keg when the tap is opened. If the tap head has been removed, the valve closes the keg in an air-tight manner such that further storage of the contents is possible. Even the drying up of any possible residue is prevented. The overpressure in the interior of the cask is maintained.

The keg head or the valve realized at this position represent primarily a special development of the connecting fitting and the seal provided in the preamble. At all events, the seal is responsible for the fact that the container or the keg, with the tap head removed, maintains the previously built-up overpressure in the interior of the container. As a rule, here, the overpressure in the case of beer is up to ca. 3 bars and up to 7 bars in the case of carbonated beverages. The named pressures are the operating pressures of the containers. The safety valve is set to this value for the fitting that supplies the carbon dioxide.

As so-called disposable containers or disposable kegs made of plastics material are increasingly being used, such containers give rise to the problem that the emptied container is typically pressurized. If improperly handled, the disposable container may burst. Such a danger exists in particular with disposable containers made of plastics material but is also there in principle in the case of disposable containers made from steel or aluminium, for example. At all events, the energy stored in an empty keg of the usual design made of, in particular, plastics material is not inconsiderable on account of the overpressure prevailing in the interior and represents a potential danger. This is where the invention aims to find a remedy.

The technical problem underlying the invention is to develop further a container of the afore-described development such that its potential danger is reduced to a minimum.

To solve this technical problem, the invention proposes, in the case of a generic container, in particular a large-volume disposable container made of plastics material such as, for example, a keg for accommodating beverages, that the connecting fitting and/or the seal define a non-closable opening for reducing pressure in the interior of the container during the subsequent automatic closing operation after a previously established opening operation.

According to the invention, therefore, the connecting fitting and/or the seal, consequently especially the keg head are structurally designed such that after a certain opening operation, the subsequent automatic closing operation in practice is not carried out completely or is not completed. For a non-closable opening remains during the said subsequent automatic closing operation. Said opening ensures that the pressure is reduced in the interior. This means that it is no longer possible for an overpressure to build up in the interior as in the previous prior art and the described potential danger consequently no longer applies.

In the majority of cases the previously established opening operation is the first opening operation after the filling of the container. In principle, the second, third, tenth or any other opening operation following the filling process can also be used as the initial trigger in practice such that the subsequent closing operation is certainly effected automatically then as always, however is no longer carried out completely, but rather leaves the non-closable opening. In the majority of cases this method of operation is effected directly subsequent to the first opening operation after the filling of the container. In reality, to this end, the connecting fitting and/or the seal are developed such that a completely sealing closure is no longer effected after the first opening procedure. In this way the overpressure contained in the container can escape in a risk free manner.

In detail there are different possibilities for converting this basic concept into practice. Thus it is conceivable that the connecting fitting is provided with an end stop for the seal. In the majority of cases, the seal undergoes impingement by a spring and the end stop is provided with a predetermined breaking point for the seal impinged upon by the spring. If after the first opening operation subsequent to the filling of the container, the connecting fitting is automatically closed by the seal undergoing impingement by the spring, the predetermined breaking point in or on the end stop is responsible for the fact that the end stop of the seal counters no or only reduced resistance. As a result of this, the end stop is deformed and/or partially removed and the seal, in conjunction with the end stop of the connecting fitting, is no longer able to seal the container completely and automatically. Rathermore, said embodiment is responsible for defining the necessary opening for the reduction of the pressure in the interior of the container.

As an alternative to or in addition to the stop member, however, the seal can also be provided with a predetermined breaking point. In this case, the automatic closing operation following the previously established opening operation is responsible for the fact that the seal undergoes a deformation in the region of the predetermined breaking point such that the opening is defined. Obviously it is also possible to combine the two measures, that is to say the predetermined breaking point in the end stop is connected to the predetermined breaking point in the seal.

Within the framework of the invention, it is also possible to provide the end stop and/or the seal with a permanent or only a temporary deformation. This means that it is conceivable that the end stop undergoes a deformation just until the overpressure built up in the interior of the container is reduced. The same may be true of the seal that can also only be deformed until the overpressure built up in the interior of the container is reduced. Besides this, it is naturally also conceivable for the end stop and the seal to undergo a permanent deformation or a deformation that is time-limited.

According to an alternative embodiment, after the established opening operation, the seal can transfer during the subsequent closing operation into a holding position at a spacing from its sealing seat on the end stop. In this case, the holding position may be maintained until the overpressure in the interior of the container is reduced. This can be accomplished, for example, by an additional spring that impinges upon the seal in the opening direction—along with the actual closing spring. Generally speaking, however, the opening of the connecting fitting or of the seal or the definition of the opening is effected in a permanent manner during the automatic closing operation, which is completed subsequent to the established opening operation.

In this context it has also proved favourable if the predetermined breaking points in the end stop and/or in the seal along with a possible deformation region of the connecting fitting and/or of the seal are arranged at a spacing from a pushing fitting. The connecting fitting and/or the seal are impinged upon for the opening operation by means of said pushing fitting. This design ensures that the predetermined breaking points and possible deformation regions are not unintentionally activated during the described opening operation with the aid of the pushing fitting.

As already explained previously, it is conceivable for the seal and/or the connecting fitting or the end stop of the connecting fitting to undergo a deformation that is only temporary until the overpressure that has built up in the interior of the container is reduced. The temporary deformation of the seal and/or of the connecting fitting or of the end stop of the connecting fitting, however, can be automatically lifted smoothly and effectively after a predetermined time interval. In the majority of cases, this time interval is generously measured which means that the pressure reduction in the interior of the container has always taken place within the time interval. To this end, time intervals of a few seconds, perhaps 10 seconds, suffice according to the invention.

It is conceivable, moreover that the deformation of the seal and/or the connecting fitting or the end stop of the connecting fitting recedes again as a function of the internal pressure in the container. This means that the seal and/or the connecting fitting or the end stop of the connecting fitting return increasingly (back) into their original state, the lower the overpressure prevailing in the interior of the container on account of the pressure reduction that is occurring in parallel.

The invention is described below by way of a drawing representing just one exemplary embodiment, in which:

FIG. 1 shows the container according to the invention in a cutout manner in the region of a container neck, FIG. 2 shows a detailed cutout from FIG. 1 and FIG. 3*a*, 3*b* show the container in FIGS. 1 and 2 in the region of the container neck during the automatic closing operation thus forming the non closable opening.

FIG. 1 shows a container, said container in the exemplary embodiment being a keg 1 made of plastics material, in particular PET (polyethylene terephthalate). Such kegs 1 are used as disposable containers for accommodating liquids, for example for accommodating beverages such as, for example, beer. Once the keg 1 has been emptied, said keg, generally speaking is reduced in volume or compressed and subsequently supplied for recycling.

The keg 1 or generally the large-volume disposable container made of plastics material is provided with a connecting fitting 2 with a seal 3. The connecting fitting 2 including the seal 3 is also referred to as a valve or keg head 2, 3. A rising pipe 4, represented in the Figures, also belongs to the basic design, through which rising pipe the liquid located in the interior of the container 1 and filled there is pressed out under pressure.

The connecting fitting 2 is made up in detail from a fitting body 2*a* and an end stop 2*b*. The fitting body 2*a* is realised as a ring-shaped flange, which is L-shaped in cross section and is inserted into a neck 5 of the keg 1. The fitting body or flange 2*a* may be connected in a force-fitting and/or form-fitting manner to the neck 5 of the keg 1, as is described in WO 2008/083782 A2. Over and above this, the fitting body or flange 2*a* serves as a support and end stop element for a spring or closing spring 6, which is supported at its foot on the fitting body 2*a* and with its head impinges upon the seal 3, which abuts against the underside of the end stop 2*b*. The rising pipe 4 is located in a fixed manner in the keg 1.

In order to fill the keg 1 as shown in the right-hand part of FIG. 2, the initially described tap head is connected to the connecting fitting 2. FIG. 2 only shows a pushing fitting 7, 8 of the tap head, said pushing fitting being made up in the exemplary embodiment shown by a pushing cylinder 7 and a sealing cylinder 8. The sealing cylinder 8 abuts at the top side against the end stop 2*b* of the connecting fitting 2, whereas the pushing cylinder 7 is in a position to open the seal 3 in opposition to the force of the closing spring 6. This is shown in the right-hand part of FIG. 2. During this operation, two paths A and B, separated from each other, are defined into the interior of the keg 1 or out of the interior of the keg 1.

The beverage can be filled into the interior of the keg 1 in the opening operation represented via both paths A and B (right-hand part of FIG. 2). During the subsequent dispensing of the beverage, the pressurized gas passes via the path B into the interior of the keg 1 and ensures that the beverage leaves the keg 1 along the path A via the rising pipe 4 and is pressed out.

After said first opening operation, according to the invention during the subsequent automatic closing operation, a non-closable opening 9 is defined corresponding to the representation in FIGS. 3*a* and 3*b*. Said opening 9 serves to reduce the pressure in the interior of the container. The automatic closing operation, in the example shown, is initiated by the dispensing tap being removed. This causes the pushing cylinder 7 impinging on the seal 3 to fall away and the seal 3 abuts against the end stop 2*b* or the two end stops 2*b*, 2*c*.

In reality, without the opening 9, the pressure of the filled gas would remain in said container. As, however, according to the invention, following the first opening operation in the case in example an automatic, self-acting pressure reduction is effected through the defined opening 9, the overpressure cannot be sustained in the interior of the keg 1, but escapes through the opening 9 to the outside.

It can be seen in the case in example shown in FIG. 3*b* that to define the opening 9, the connecting fitting 2 or its end stop 2*b* is provided with a predetermined breaking point 10. According to the described beverage discharge corresponding to the right-hand part of FIG. 2, as soon as the closing spring 6 ensures, during the subsequent automatic closing operation, that the seal 3 is pressed (again) against the end stop 2*b*, 2*c*, the predetermined breaking point 10 ensures that the overpressure prevailing in the interior of the keg 1, in conjunction with the force of the closing spring 6, deforms the end stop 2*b*, for example as is shown in FIG. 3*b*. As a result of this, the seal 3 is no longer able to close the keg 1 completely, but rather, as a result of an inclined position produced by the end stop 2*b* partly falling away, the opening 9 remains.—The same is true if, alternatively or additionally, the end stop 2*c* at the rising pipe 4 is provided with the predetermined breaking point 10 which is also indicated.

In this case, the design overall is such that the pushing cylinder 7 has an outside diameter d which is dimensioned smaller than a diameter $d_a$ of the predetermined breaking points 10. In reality, the predetermined breaking points 10 follow the circular end stop 2*b* and are located all in all on a circle with the diameter $d_a$. The inside diameter $d_i$ of the sealing cylinder 8 is then dimensioned greater than the diameter $d_a$ of the predetermined breaking points 10 and corresponds substantially to the outside diameter of the neck 5 of the keg 1. This design is produced on account of the fact that the keg 1 and as a result its neck 5 and accordingly the connecting fitting 2 and also the seal 3 are realized in each case in a rotationally symmetrical manner to the axis A.

It should be emphasized that the predetermined breaking points 10 are located in each case such that the end stop 2*b* fulfils its function if the seal 3 is closed by means of the closing spring 6, as can be seen in the left-hand part of FIG. 2. This applies in each case as long as the end stop 2*b* is impinged upon just with the force of the closing spring 6. If, contrary to this, additional overpressure is built up in the interior of the container or keg 1, the end stop 2*b* can no longer fulfill its function fully or the end stop 2*b* yields in the region of the predetermined breaking points 10. This can be traced back to the combined force of the closing spring 6 in conjunction with the overpressure prevailing in the interior of the keg 1. Said overpressure is only built up in the keg 1 when the first opening operation and the pressing out of the liquid through the rising pipe 4 is effected after the filling of the container or the keg 1. As during this operation the seal is raised from the end stop 2*b* by means of the pushing cylinder 7, the end stop 2*b* is not under load.

Only when the liquid has been pressed out of the keg 1 and an automatic closing operation follows said first opening operation and the dispensing of the beverage, the overpressure still prevailing in the interior, in conjunction with the closing spring 6, then ensures that the end stop 2*b* undergoes the deformation represented in FIG. 3*b* in the region of the predetermined breaking points 10 and that the seal 3 in the case in example is inclined, thus defining the opening 9.

As an alternative to this method of operation, it is naturally also possible to provide the end stop 2*c* with the indicated predetermined breaking points 10 for the seal 3 in the region of the rising pipe 4. The method of operation is comparable to that with the predetermined breaking points 10 of the end stop 2*b*.

FIG. 3*a* shows another variant of how the opening 9 for the reduction of the pressure in the interior of the container during the automatic closing operation following the previously established opening operation or the first opening operation can be defined when dispensing the liquid. In this case the design is such that, after the established or first opening operation, the seal 3 transfers into a holding position at a spacing from its sealing seat or the end stop 2*b*, 2*c* during the subsequent closing operation. Said holding position according to FIG. 3*a* may also be described as a locking position.

In detail it can be managed such that, during the first opening operation of the keg 1 or when the beverage is dispensed, the pushing cylinder 7 deforms the end stop 2*b*, 2*c* such said end stop forms a nose 11 which, during the subsequent automatic closing operation, keeps the seal 3 at a spacing from the end stop 2*b* and also from the end stop 2*c* at the rising pipe 4. This results in once again defining the opening 9 that makes the reduction of the pressure in the interior of the container possible. In this case it is obvious that the outside diameter d of the pushing cylinder 7 has to be dimensioned such that the end stop 2*b* is grasped at its edge by the pushing cylinder 7 and results in the described bending-round or the realization of the nose 11 on the end stop 2*b*.

Not explicitly represented is the further possibility of deforming the seal 3 during the opening operation, corresponding to FIG. 2 in the right-hand part, for example by means of the pushing cylinder 7 such that whilst maintaining the end stops 2*b* and 2*c* the seal 3 as such predetermines the opening 9. It is also possible to combine these measures. Moreover, it is within the framework of the invention to adjust the described deformations of, on the one hand, the seal 3 and, on the other hand, the end stops 2*b*, 2*c* or generally speaking of the connecting fitting 2 such that the deformations in this case are only temporary. In reality, it is conceivable for the deformations to be automatically lifted again after a certain time period or to undergo corresponding elimination as the pressure is reduced in the interior of the keg 1. In the case in example in FIG. 3*a*, this means that as the pressure is increasingly reduced in the interior of the keg 1 and on account of the force of the closing spring 6 acting on it, the nose 11 is increasingly bent back again.

At all events, within the framework of the invention the energy stored in the shape of the overpressure in the interior of the keg 1 is reduced and consequently no longer poses any risk. In this connection, the keg 1 may no longer be closed in a permanently sealing manner via the opening 9 which means that the contents of the keg 1 are irretrievably exposed to ruin. However, alternative methods of operation provide that the opening 9 is only defined in a temporary manner and, generally speaking, once the pressure has been reduced in the interior of the keg 1, it once again undergoes total closure. Either way safety is enormously increased, which was the goal.

The invention claimed is:

1. A manufacture for accommodating liquids, said manufacture comprising a container, a connecting fitting in said container, and a seal associated with said connecting fitting, said connecting fitting being configured such that a subsequent automatic closing operation for closing the container, which follows an opening operation of said container, can no longer be fully carried out, said subsequent automatic closing operation thereby being an incomplete automatic closing operation, whereby, after said incomplete closing operation, an opening remains for reducing pressure in an interior of said container, and wherein said opening operation is the first opening operation after the filling of the container, and wherein the connecting fitting comprises a predetermined breaking point.

2. The manufacture of claim 1, wherein the connecting fitting comprises an end stop impinged upon by a spring, the end stop having said predetermined breaking point for being broken by the seal.

3. The manufacture of claim 1, wherein, during the subsequent automatic closing operation, the seal undergoes a deformation that defines the opening.

4. The manufacture of claim 1, wherein, during the subsequent automatic closing operation, the connecting fitting undergoes a deformation that defines the opening.

5. The manufacture of claim 2, wherein, during the subsequent automatic closing operation, the seal moves into a holding position at a spacing from the end stop.

6. The manufacture of claim 1, wherein a structure selected from the group consisting of the connecting fitting and the seal comprises a deformation region arranged at a spacing from a pushing fitting that impinges upon the structure.

7. The manufacture of claim 1, wherein the container is a disposable plastic keg.

8. A manufacture for accommodating liquids, said manufacture comprising a container, a connecting fitting in said container, and a seal associated with said connecting fitting, said connecting fitting being configured such that a subsequent automatic closing operation for closing the container, which follows an opening operation of said container, can no longer be fully carried out, said subsequent automatic closing operation thereby being an incomplete automatic closing operation, whereby, after said incomplete closing operation, an opening remains for reducing pressure in an interior of said container, and wherein said opening operation is the first opening operation after the filling of the container, and wherein a structure selected from the group consisting of the connecting fitting and the seal comprises a predetermined breaking point at a spacing from a pushing fitting that impinges upon the structure.

9. The manufacture of claim 8, wherein the connecting fitting comprises an end stop impinged upon by a spring, the end stop having a predetermined breaking point for being broken by the seal.

10. The manufacture of claim 8, wherein, during the subsequent automatic closing operation, the seal undergoes a deformation that defines the opening.

11. The manufacture of claim 8, wherein, during the subsequent automatic closing operation, the connecting fitting undergoes a deformation that defines the opening.

12. The manufacture of claim 9, wherein, during the subsequent automatic closing operation, the seal moves into a holding position at a spacing from the end stop.

13. The manufacture of claim 8, wherein the structure further comprises a deformation region arranged at a spacing from the pushing fitting.

* * * * *